United States Patent [19]

Chetcuti et al.

[11] Patent Number: 4,650,339

[45] Date of Patent: Mar. 17, 1987

[54] SOLUTION MIXING METHOD AND APPARATUS

[75] Inventors: Raphael J. F. Chetcuti, South Wirral; John E. Melbourne, Sanbach, both of England

[73] Assignee: Ciba-Geigy AG, Basel, Switzerland

[21] Appl. No.: 829,855

[22] Filed: Feb. 14, 1986

Related U.S. Application Data

[63] Continuation of Ser. No. 635,698, Jul. 30, 1984, abandoned.

[30] Foreign Application Priority Data

Aug. 12, 1983 [GB] United Kingdom ..... 8321794

[51] Int. Cl.[4] ..... B01F 15/00

[52] U.S. Cl. ..... 366/142; 137/563; 137/565; 222/1; 354/324; 354/331; 366/166; 366/341

[58] Field of Search ..... 366/131, 132, 136, 137, 366/142, 159, 166, 167, 182, 341, 153, 348; 354/324, 297, 325, 344, 331; 137/565, 563, 571, 574; 118/429; 134/186, 182, 64 P, 122 P; 222/1 R

[56] References Cited

U.S. PATENT DOCUMENTS 1,917,577 7/1933 Doble, Jr. .

4,002,267 1/1977 Aelterman et al. ..... 222/1

4,096,066 6/1978 Kearney ..... 210/195 R

*Primary Examiner*—Timothy F. Simone

*Attorney, Agent, or Firm*—Harry Falber

[57] ABSTRACT

There is described a method of preparing working strength solution in a processing apparatus which comprises adding a requisite volume of concentrated solution to a storage vessel until the liquid level on the storage vessel reaches the top of a standpipe in the storage vessel and continuing to add diluent to the storage vessel so that excess liquid in the storage vessel flows down the standpipe to a connected working vessel, stopping the flow of diluent when the volume of liquid in the working vessel reaches a predetermined volume, then commencing to pump liquid drawn in part at least from the bottom of the working vessel into the storage vessel, the excess liquid in the storage vessel flowing into the working vessel, and continuing to pump liquid from the working vessel to the storage vessel until the specific gravities of the liquid in the storage vessel and in the working vessel are the same.

Pumping the liquid from the working vessel to the storage vessel until the specific gravities of the liquid in the two vessels is the same ensures that complete mixing of the concentrated solution and diluent has taken place.

An apparatus for carrying out the method is also described.

3 Claims, 5 Drawing Figures

SOLUTION MIXING METHOD AND APPARATUS

Figure 1:
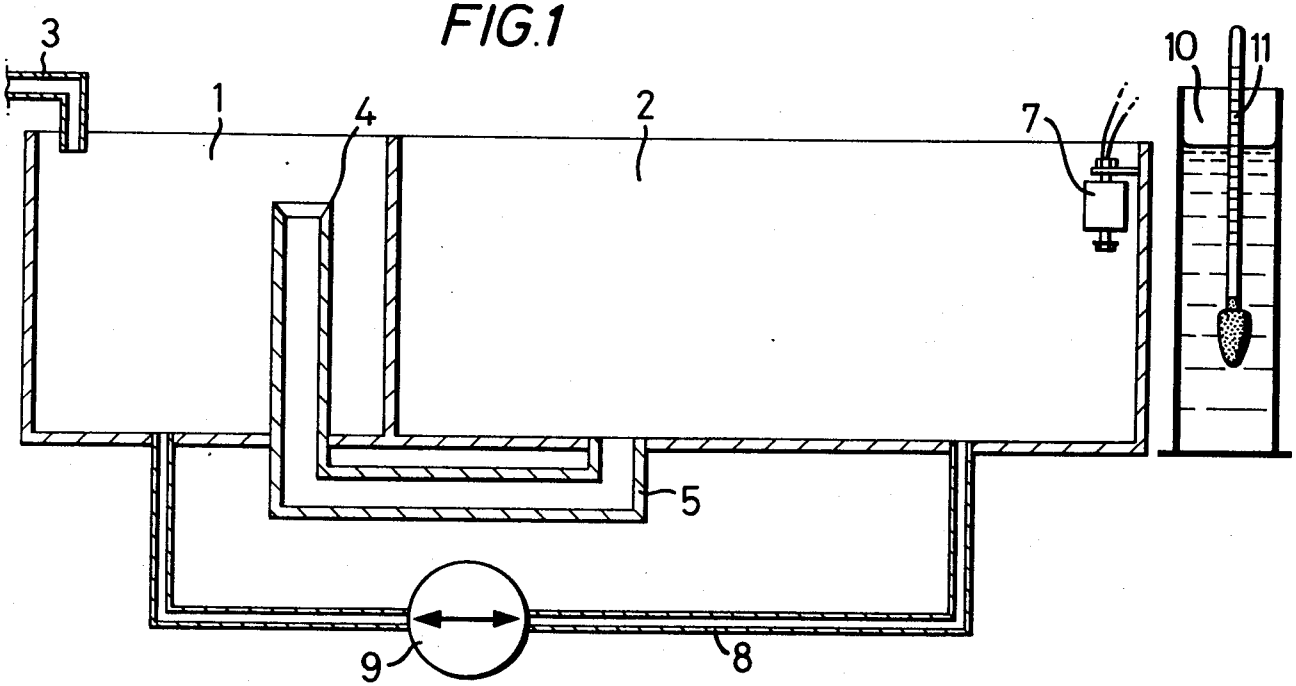

This application is a continuation of application Ser. No. 635,698, filed July 30, 1984, now abandoned.

This invention relates to a method and an apparatus for preparing liquid mixtures. The invention is particularly, but not exclusively, concerned with preparing dilute solutions from a concentrated liquid and a diluent but it will be appreciated that it may be employed where mixtures of miscible liquids are required.

In many manufacturing processes or processes in which material is treated in a liquid, it is necessary to prepare treatment liquids of predetermined strength as accurately and as quickly as possible. In many cases it is desirable to prepare a bath of treatment liquid and a bath of replenishment liquid of the same strength for replenishing the bath of treatment liquid as liquid is lost from the bath by evaporation, reaction or carry over on material passed through the bath. This is particularly the case where sheet material is passed through a bath of treatment liquid.

In order to prepare the two baths, four liquid measurements are required, two of which may involve a concentrated liquid and two of which may involve a diluent. If the concentrated liquid is highly caustic or acidic or otherwise presents a health hazard, it is obviously undesirable to carry out a number of measurements involving the concentrated liquid.

Furthermore, when mixing some concentrated solutions with a diluent it is extremely difficult to obtain a uniform concentration throughout the diluent volume, without any pockets of weaker or more concentrated solution being present.

In one prior patent specification U.S. Pat. No. 4,002,267, there is described a method of preparing solutions from a concentrate and a diluent. In this method the concentrate is placed in a holding unit. The contents of the holding unit are then emptied into a conduit leading to a supply tank and at the same time a measured volume of diluent is passed into the same conduit to prepare the diluted solution in the supply tank. This requires a complex pipeline network and a very accurate diluent volume measuring means. Furthermore, no provision is made to ensure that the diluted liquid in the supply tank has been thoroughly and properly mixed.

It is the object of the present invention to provide a method and apparatus with which liquid mixtures for a treating bath and an associated replenishment bath can be prepared easily without the necessity for making any measurement on either liquid. Also to ensure that the liquid throughout the apparatus is of uniform concentration.

According to the present invention there is provided a method of preparing working strength solution in a processing apparatus which comprises adding a requisite volume of concentrated solution to a storage vessel in the apparatus, adding liquid diluent to the storage vessel until the liquid level on the storage vessel reaches the top of the standpipe in a storage vessel and continuing to add diluent to the storage vessel so that excess liquid in the storage vessel flows down the standpipe to a connected working vessel, stopping the flow of diluent when the volume of liquid in the working vessel reaches a predetermined volume, then commencing to pump liquid drawn in part at least from the bottom of the working vessel into the storage vessel, the excess liquid in the storage vessel flowing into the working vessel, and continuing to pump liquid from the working vessel to the storage vessel until the specific gravities of the liquid in the storage vessel and in the working vessel are the same.

Preferably pre-packed measured volumes of the concentrated liquid are added to the storage vessel.

It has been found before pumping of liquid from the working vessel to the storage vessel is commenced that the specific gravities in the two vessels and even in different parts of the same vessel vary considerably showing that the concentrated solution and diluent have not been properly mixed. However after the pump has been working a few minutes the specific gravities of the liquid in the two vessels and in the various parts thereof are approaching uniformity. After further circulation of the liquid by the pump from the working vessel to the storage vessel the specific gravity of the liquid in each vessel and in each part thereof will be found to be the same, showing that complete mixing of the concentrated solution and diluent has occurred.

According to another aspect of the present invention there is provided in a material processing apparatus means for preparing a working strength processing solution from a concentrated solution and a diluent which comprises a liquid storage vessel having an overflow standpipe located therein, which is connected to a working vessel in which the material is to be processed using the processing solution, so that excess liquid present in the storage vessel flows to the working vessel, means to add diluent liquid to the storage vessel, liquid level indicator means present in the working vessel, a liquid pump which is connected to pump liquid from the bottom of the working vessel to the bottom of the storage vessel and means for determining the specific gravity of the liquids.

The accompanying figures will serve to illustrate the invention.

All the FIGS. 1 to 5 show a cross-sectional side view of the apparatus employed in the present invention and in each of the figures the same number designates the same feature.

In FIG. 1 an empty apparatus is shown which comprises a liquid storage vessel 1 and a processing liquid working vessel 2. It is required that concentrated liquid and diluent which in this case is water are mixed in the storage vessel 1 and then fed to the working vessel 2 to provide in the working vessel 2 a liquid having a predetermined concentration of active ingredients, and to provide in the storage vessel 1 a liquid having the same concentration of active ingredients which can be used to replenish the liquid in the working vessel 2.

Shown in storage vessel 1 is a water supply means 3 and an open ended standpipe 4 which is connected via a tube 5 to the bottom of working vessel 2. Present in working vessel 2 is a liquid level switch 7 which turns off the diluent water when the liquid level reaches a predetermined height.

A pipe 8 is shown connecting the bottoms of the two vessels 1 and 2. In the pipe 8 is a pump 9 which is able to pump liquid either from vessel 1 to vessel 2 or from vessel 2 to vessel 1.

Shown to the right of vessel 2 is a hydrometer jar 10 containing a hydrometer 11 which is used to determine the specific gravity of the liquids.

Figure 2:
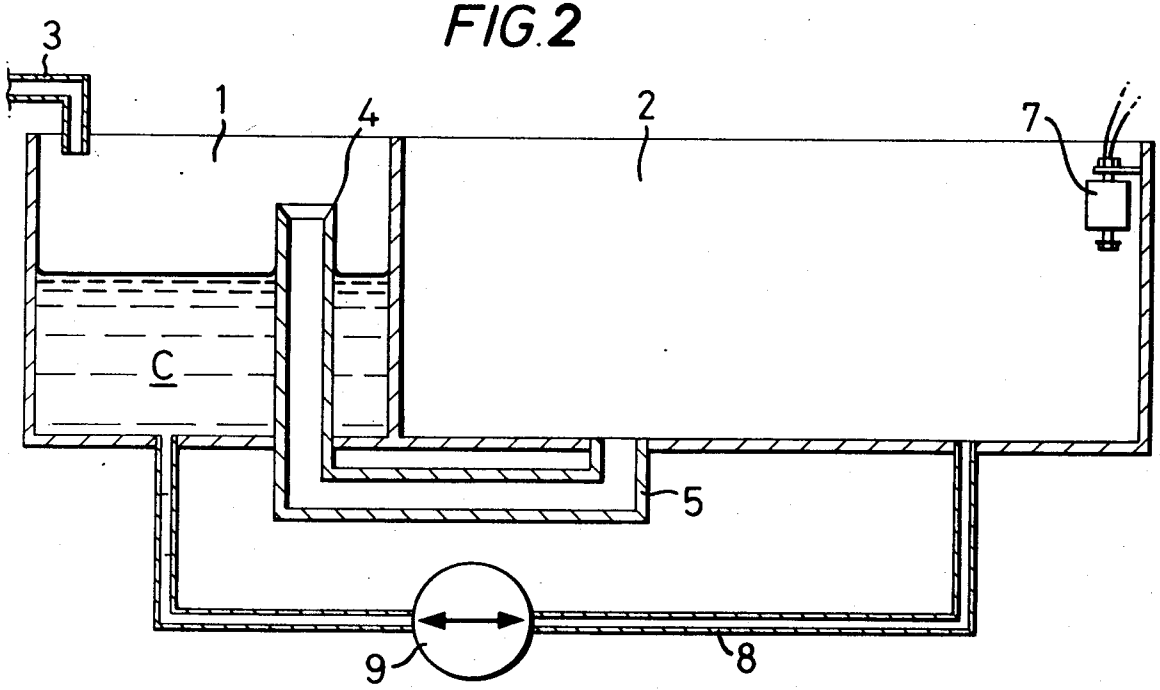

In FIG. 1 both vessels 1 and 2 are empty of liquid. In FIG. 2 is shown a predetermined volume of concentrated liquid C, which has been poured from a prepacked container into the storage vessel 1. The volume is such that it reaches part-way up the height of the standpipe 4.

Figure 3:
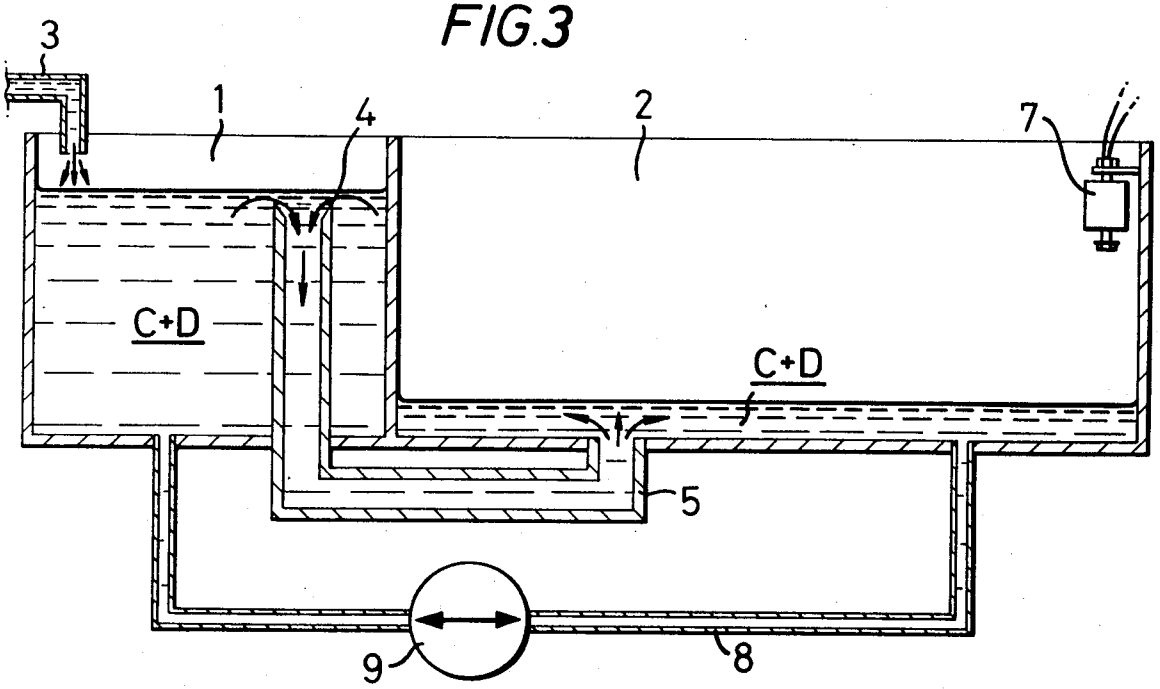

In FIG. 3 the diluent water D is shown issuing from the water supply means 3. The water D partly mixes with the concentrated liquid C and the liquid volume rises so that the excess liquid flows down the stand-pipe 4 into the working vessel 2. The liquid in these two vessels have been designated C+D to show that it is incompleteley mixed.

Figure 4:
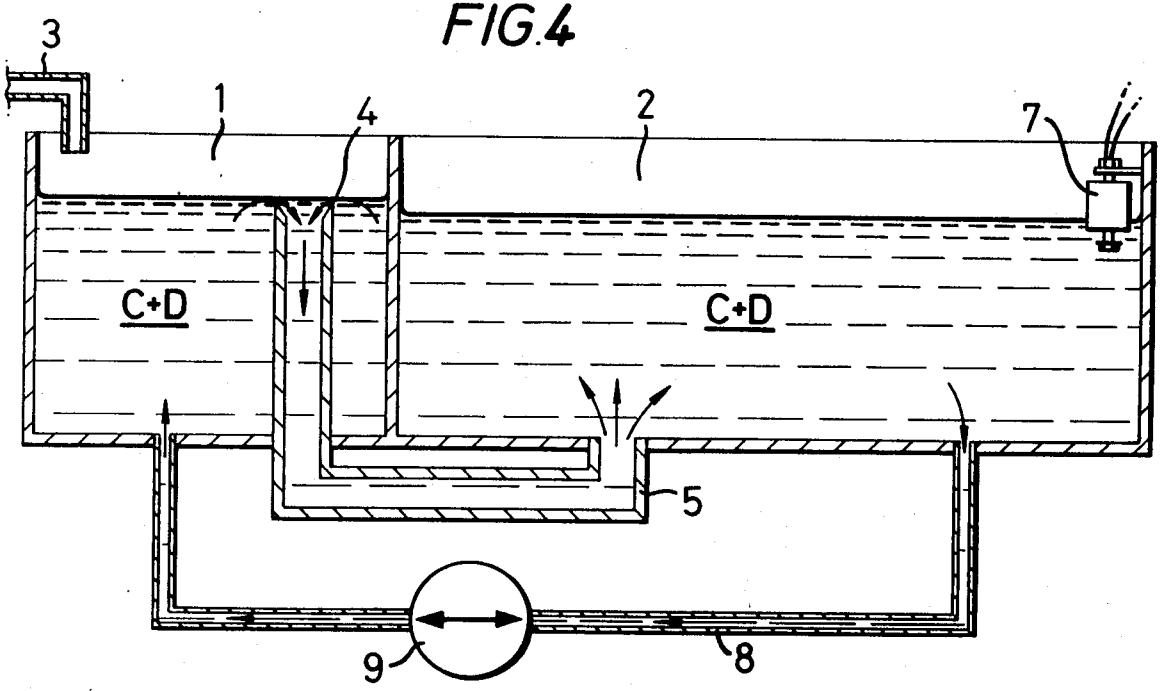

In FIG. 4 sufficient water D has flowed into the storage vessel 1 to raise the liquid level in the working vessel 2 to the requisite height. The liquid level switch 7 has operated and the water supply has been turned off.

Thus at this stage both vessel 1 and vessel 2 contain incompletely mixed liquid C+D.

The pump 9 is then caused to pump liquid from vessel 2 into vessel 1, the excess liquid in vessel 1 then flowing via the stand pipe 4 to vessel 2. Thus maintaining the liquid level in vessel 2.

Specific gravity measurements of the liquid in the two vessels are then taken by use of the hydrometer jar 10 and the hydrometer 11. Until the specific gravities obtained of the two liquids are found to be consistent. The pump 9 is then stopped.

Figure 5:
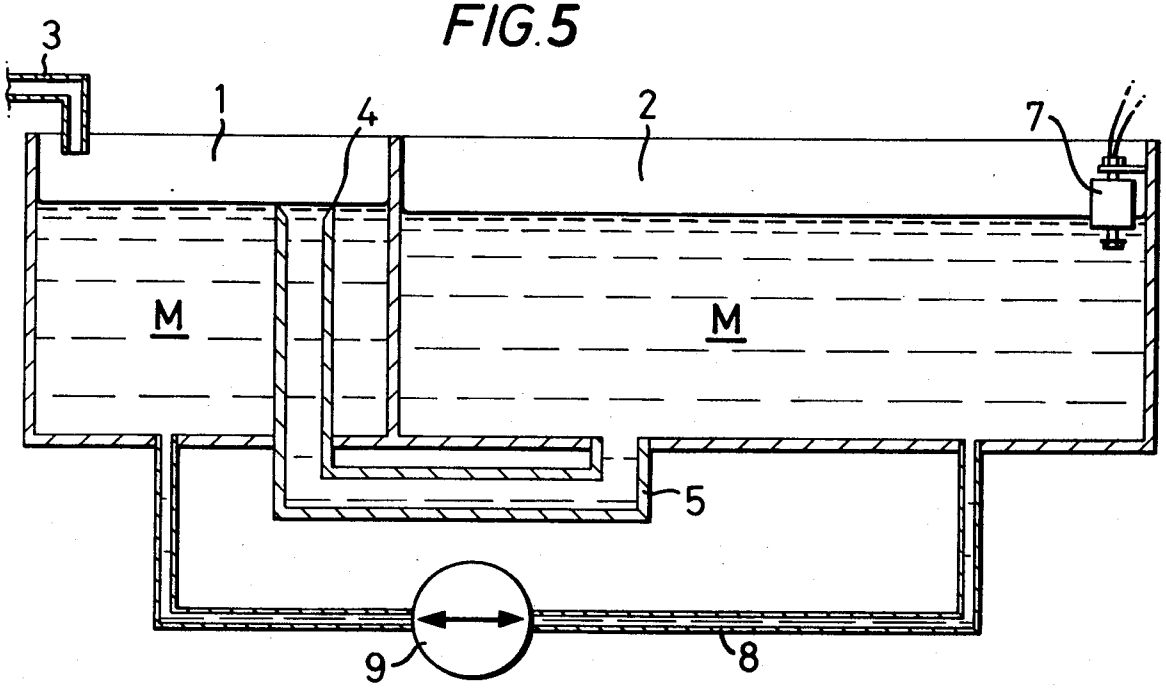

This is the position shown in FIG. 5 when both vessels 1 and 2 contained working strength processed liquid M which has been properly mixed.

In operation as material is processed in the working vessel 2 liquid from this vessel will be removed thereby. When the level indicator 7 is triggered a pump 9 is then activated to pump liquid from the storage vessel 1 to the working vessel 2 to maintain the level of the liquid in this vessel.

In one operation the apparatus of FIGS. 1 to 5 was used to prepare working strength photographic fixing solution and photographic prints were fixed in the working vessel 2.

In this case the main active ingredient of the fixing solution is ammonium thiosulphate.

A concentrated solution of ammonium thiosulphate available commercially contained 687.2 g/liter and had a specific gravity of 1.335.

The concentration of ammonium thiosulphate in the working strength solution was required to be 137.44 g/liter. This has a specific gravity of 1.076.

3 liters of concentrated thiosulphate solution C was added to vessel 1 as shown in FIG. 2. Water D was added as shown in FIG. 4 until the total volume of liquid C+D was 15 liters.

Thus theoretically the concentration of ammonium thiosulphate in the liquid in the two vessels was 137.44 g/liters which is the required concentration.

However specific gravity requirements showed that the actual concentration varied considerably in the two tanks and in different parts of each tank.

In one test the specific gravity was taken before pumping was commenced at the state shown in FIG. 4. The results were as shown below:

| | | sp: gr: |
|---|---|---|
| Vessel 2 | Top | 1.082 |
| Vessel 2 | Bottom | 1.112 |
| Vessel 1 | Top | 1.030 |
| Vessel 1 | Bottom | 1.100 |

After five minutes of pumping liquid from vessel 2 to vessel 1 the readings were as follows:

| | | sp: gr: |
|---|---|---|
| Vessel 2 | Top | 1.074 |
| Vessel 2 | Bottom | 1.080 |
| Vessel 1 | Top | 1.070 |
| Vessel 1 | Bottom | 1.070 |

However after 12 minutes pumping the specific gravity results were as follows:

| | | sp: gr: |
|---|---|---|
| Vessel 1 | Top | 1.076 |
| Vessel 1 | Bottom | 1.076 |
| Vessel 2 | Top | 1.076 |
| Vessel 2 | Bottom | 1.076 |

This showed that the concentrated ammonium thiosulphate solution had been correctly mixed with water to provide a uniform working strength solution of 137.44 g/liters of ammonium thiosulphate throughout the apparatus. This result was confirmed by chemical analysis of the liquid M both in vessel 1 and in vessel 2.

In general operation once the length of time required to obtain consistent specific gravity readings throughout the apparatus has been established using that particular concentrated solution this length of time for mixing is used each time and specific gravity readings are not needed.

We claim:

1. A method of preparing working strength solution in a processing apparatus which comprises adding a requisite volume of concentrated solution solely to a storage vessel in the apparatus, adding liquid diluent solely to and directly into the concentrated solution in the storage vessel so as to partly mix therewith until the liquid level in the storage vessel reaches the top of a standpipe in the storage vessel and continuing to add diluent solely to and directly into the concentrated solution in the storage vessel so that excess partly (mixed liquid) in the storage vessel flows down the standpipe to a connected working vessel, stopping the flow of diluent when the volume of liquid in the working vessel reaches a predetermined volume, then commencing to pump liquid drawn in part at least from the bottom of the working vessel into the storage vessel, the excess liquid in the storage vessel flowing into the working vessel, and continuing to pump liquid from the working vessel to the storage vessel until the specific gravities of the liquid in the storage vessel and in the working vessel are the same.

2. A method according to claim 1 wherein a prepacked measured volume of concentrated solution is added to the storage vessel.

3. A material processing apparatus which comprises means for preparing a working strength processing solution from a requisite volume of a concentrated solution and a diluent which comprises a liquid storage vessel having an overflow standpipe located therein; means for introducing said concentrated solution into said storage vessel, the height of the standpipe being greater than the height of the concentrated solution introduced into said storage vessel as determined by the requisite volume of the solution and the dimensions of the storage vessel; means for adding diluent liquid to the storage vessel; a working vessel in which the material is to be processed using the processing solution; means for connecting the working vessel to the standpipe, so that any volume of liquid in the storage vessel which is higher than the standpipe flows to the working vessel; liquid level indicator means present in the working vessel; a multi-directional liquid pump which is connected to pump liquid from the bottom of the working vessel to the bottom of the storage vessel and to pump working strength processing solution from the storage vessel to the working vessel; and means for determining the specific gravity of the liquids.

* * * * *